United States Patent [19]

Philip et al.

[11] 4,157,258

[45] Jun. 5, 1979

[54] CASE-HARDENING ALLOY STEEL AND CASE-HARDENED ARTICLE MADE THEREFROM

[75] Inventors: Thoni V. Philip; Robert W. Krieble, both of Reading, Pa.

[73] Assignee: Carpenter Technology Corporation, Reading, Pa.

[21] Appl. No.: 935,003

[22] Filed: Aug. 18, 1978

Related U.S. Application Data

[63] Continuation-in-part of Ser. No. 815,231, Jul. 13, 1977, abandoned.

[51] Int. Cl.[2] ..... C22C 38/42; C22C 38/44

[52] U.S. Cl. ..... 75/124; 75/125; 75/128 E; 75/128 G; 75/128 Z; 75/128 T; 75/128 V; 75/128 W; 148/31.5; 148/36

[58] Field of Search ..... 75/125, 124, 128 V, 75/128 W, 128 E, 128 T, 128 G, 128 Z; 148/31.5, 36, 39

[56] References Cited

U.S. PATENT DOCUMENTS

| | | | |
|---|---|---|---|
| 3,036,912 | 5/1962 | Roberts et al. | 75/126 C |
| 3,661,565 | 5/1972 | Harvey | 75/125 |
| 3,713,905 | 1/1973 | Philip et al. | 148/36 |

*Primary Examiner*—Arthur J. Steiner
*Attorney, Agent, or Firm*—Edgar N. Jay

[57] ABSTRACT

A carburizing alloy steel and case-hardened articles made therefrom, having high core impact strength and fracture toughness combined with high case hot hardness and temper resistance at 400° F. (204° C.), containing 0.06–0.16% carbon, 0.2–0.7% manganese, 0.5–1.5% silicon, 0.5–1.5% chromium, 1.5–3% nickel, 1–4% copper, 2.5–4% molybdenum, up to 0.4% vanadium, and the balance iron and incidental impurities. The alloy may also contain small amounts of phosphorus, sulfur, nitrogen, aluminum, columbium, titanium, zirconium, and calcium.

14 Claims, No Drawings

CASE-HARDENING ALLOY STEEL AND CASE-HARDENED ARTICLE MADE THEREFROM

CROSS REFERENCES

This application is a continuation-in-part of our copending application Ser. No. 815,231, filed July 13, 1977, assigned to the assignee of this application, now abandoned.

BACKGROUND OF THE INVENTION

This invention relates to a case-hardening alloy steel and case-hardened articles made therefrom and, more particularly, to such an alloy steel which when carburized and hardened has a unique combination of surface hot hardness and temper resistance with good internal impact strength and fracture toughness.

Articles such as gears or gear trains, particularly helicopter gear systems, which require temper resistance, hot hardness, fracture toughness and impact strength for operation at elevated temperatures have been in demand to meet the more exacting operating conditions to be encountered in equipments, such as helicopters, now under development. Hitherto, such carburizing alloy steels as A.I.S.I. Type 9310, Type 3310, Type 8620 and others have been used to provide articles such as gears for such purposes. However, the more demanding operating conditions encountered in the power trains of helicopters now under development, are too rigorous for such carburizing alloy steels. For example, A.I.S.I. Type 9310 contains in weight percent:

| | |
|---|---|
| C | 0.08–0.13 |
| Mn | 0.45–0.65 |
| Si | 0.20–0.35 |
| Cr | 1.00–1.40 |
| Ni | 3.00–3.50 |
| Mo | 0.08–0.15 |

with the balance iron and incidental impurities including no more than 0.025% phosphorus and 0.025% sulfur. While Type 9310 has excellent toughness, it does not have the temper resistance and hot hardness required for operation at the elevated temperatures now contemplated which may range as high as 400° F. (204° C.). In U.S. Pat. No. 3,713,905 granted to T. V. Philip and R. L. Vedder on January 30, 1973 and assigned to the assignee of the present application, there is disclosed an alloy steel of outstanding properties containing in weight percent:

| | Broad |
|---|---|
| C | 0.07–0.8 |
| Mn | Up to 1 |
| Si | 0.5–2 |
| Cr | 0.5–1.5 |
| Ni | 2–5 |
| Cu | 0.65–4 |
| Mo | 0.25–1.5 |
| V | Up to 0.5 |

with the balance iron and incidental amounts of other elements. That alloy with 0.07–0.2% carbon is readily case hardened, as by carburizing, and in that condition provides articles having good toughness and temper resistance and hot hardness better than obtainable with Type 9310. While the impact toughness of the alloy provided by that patent is high enough, its temper resistance and hot hardness are not considered to be adequate to meet such demanding conditions as those experienced by the gears in helicopters now under development. Another alloy steel which has been considered for use in making such articles as gears to be used in helicopters at temperatures up to 400° F. is that disclosed in U.S. Pat. No. 3,036,912 granted to Roberts et al on May 29, 1962, but that alloy was found to have inadequate impact strength and fracture toughness.

SUMMARY OF THE INVENTION

It is, therefore, a principal object of this invention to provide an alloy steel which can be prepared, case hardened and heat treated utilizing conventional techniques to provide a unique combination of properties including high core impact strength and fracture toughness combined with a high degree of temper resistance and high hot hardness.

It is a further object of this invention to provide case-hardened and heat-treated articles having such an alloy steel composition and which have high core impact strength and fracture toughness combined with high temper resistance and high hot hardness when exposed to temperatures as high as 400° F. (204° C.).

A more specific object of this invention is to provide such an alloy steel and case-hardened, heat-treated articles made therefrom which have a core hardness of about Rc 32–38, which at room temperature have a Charpy V-notch impact strength of at least about 60 ft-lb (81.4 J) and a fracture toughness of at least about 80 ksi $\sqrt{in}$ (87.91 $MN/m^2 \sqrt{m}$)* combined with a room temperature hardness of the case of at least Rc 60 and a hot hardness at 400° F. (204° C.) of at least Rc 56 or a heat-treated hardness such that the loss in hardness from room temperature to 400° F. (204° C.) is no more than 4 on the Rockwell C scale.

*M=($\times 10^6$)

The foregoing objects and advantages of the present invention are attained in accordance with the present invention by providing a composition containing essentially the elements carbon, manganese, silicon, chromium, nickel, copper and molybdenum in the amounts indicated, in weight percent (w/o), in Table I by way of summary and then case hardening and heat treating the article made therefrom as will be more fully pointed out hereinbelow.

TABLE I

| | Broad | Preferred |
|---|---|---|
| C | 0.06–0.16 | 0.07–0.13 |
| Mn | 0.2–0.7 | 0.25–0.5 |
| Si | 0.5–1.5 | 0.75–1.25 |
| Cr | 0.5–1.5 | 0.75–1.25 |
| Ni | 1.5–3 | 1.7–2.3 |
| Cu | 1–4 | 1.5–2.5 |
| Mo | 2.5–4 | 3–3.5 |
| V | Up to 0.4 | 0.05–0.15 |

The remainder of the alloy is iron except for incidental amounts of elements which may vary from a few hundredths of a percent or less, that is up to about 0.05% in the case of phosphorus and sulfur, up to about 0.03% nitrogen and up to about one-quarter percent, preferably less than 0.1%, as in the case of those elements such as aluminum, columbium, titanium, zirconium and calcium which may be used as deoxidizers and/or grain refiners. For any beneficial effect, the amount of aluminum, columbium and titanium, when present, should each amount to 0.01%, and the amount of zirconium and calcium, when present, should each amount to at least 0.001%, but the amount of these elements used should not be so large as to affect undesirably the required properties, particularly the hardness of the case and toughness of the core. Further objects and advantages of the present invention will be apparent from the following detailed description thereof.

DETAILED DESCRIPTION

Carbon primarily contributes to the attainable hardness level and depth of hardenability. Below about 0.06% carbon, and hardness capability, that is the attainable as-heat-treated hardness, for the core material of a case-hardened article will be too low. In practice, the minimum core hardness desired of articles such as gears for which this alloy is intended is about Rc 32. As the amount of carbon present is increased, the attainable as-hardened hardness for any given total alloy content is increased, as is the case for such hypoeutectoid compositions, and, at the same time, the impact strength is decreased. Because of the adverse effect of carbon on impact strength, carbon is limited to no more than 0.16%. For the best combination of hardness capability and impact strength in the core, 0.07%–0.13% carbon is used. Intermediate ranges also are contemplated, that is, 0.06–0.13% and 0.07–0.16% carbon.

Manganese contributes to the deep hardenability of this alloy, and, for this effect, a minimum of 0.2% is required. However, because of its volatile nature and difficulty of providing consistent results above about 0.7%, no more than that amount is used when, as is preferred, the alloy is prepared using consumable electrode remelting techniques. The alloy is readily prepared to a high degree of homogeneity and purity by means of consumable electrode remelting techniques which, for best results, are preferably carried out under reduced pressure and with the manganese content limited to no more than 0.5%. When so prepared, the outstanding properties provided when the remaining elements are maintained within the stated ranges are readily and consistently attainable. Also, at least 0.25% manganese is preferably used, but 0.2%–0.5% and 0.25%–0.7% manganese are also contemplated.

Excessive amounts of manganese, and to some degree this is true of other austenite-forming elements such as nickel and copper, result in the retention of undesired amounts of austenite in the heat-treated hardened case of an article made from the composition. Such retained austenite tends to transform in service to martensite which is not only relatively brittle, but its formation is also accompanied by an increase in the volume of the part. In addition, retained austenite tends to decrease the hardness and wear resistance of the hardened case. Such transformations are not desirable in the parts such as gears or bearings for which this composition is primarily intended to be used. The retention of excessive austenite is avoided by keeping manganese below 0.7% and better yet, below 0.50%.

Silicon, nickel and copper function as solid-solution strengtheners. Silicon also contributes to the hardenability of the composition and retards tempering. For these purposes, at least about 0.5% silicon is required, and preferably a minimum of 0.75% is used. Increasing silicon above about 1.5% is to be avoided because of the adverse effect upon the alloy's impact strength and because of the formation of a brittle constituent known as delta ferrite. Preferably, silicon is limited to no more than 1.25%, but 0.5%–1.25% and 0.75%–1.5% are also contemplated.

In this alloy, chromium provides resistance to oxidation and minimizes scale formation when the alloy is hot worked. Chromium also contributes to the deep hardenability of the alloy. For these effects, a minimum of 0.5% chromium is required and, preferably, a minimum of 0.75% is present. Because of its detrimental effect on impact properties when larger amounts are present, chromium is limited to about 1.5% and preferably to no more than 1.25%, but 0.5%–1.25% and 0.75%–1.5% are also contemplated.

Unlike silicon which is a ferrite former, nickel and copper which also function as solid-solution strengtheners in this composition, tend to stabilize austenite. When present together in an excessive amount, nickel and copper tend to promote the undesired retention of austenite in the hardened case of the alloy similar to but to a lesser extent than manganese. Therefore, in balancing this composition, the larger permitted amounts of nickel and copper are not used together, and for best results, the sum of the percent nickel plus one half the percent copper should be equal to or less than 4%. At least 1.5% nickel is used because of its beneficial effect on subzero impact strength. Because of the tendency of increasing nickel to adversely affect room temperature impact strength, no more than 3% nickel is used. Preferably, 1.7%–2.3% nickel is used for best results, but 1.5%–2.3% and 1.7%–3% are also contemplated.

Copper has a beneficial effect on the room temperature impact strength of this alloy and can be used up to about 4% for this purpose. Above about 4%, copper causes forging difficulties, and precipitation of copper may occur when the alloy with such excessive amounts of copper is maintained at temperatures of about 750° F. (about 400° C.) or above. Preferably, 1.5–2.5% copper is used, but 1%–2.5% and 1.5%–4% are also contemplated.

Vanadium is not an essential addition to this alloy, but up to about 0.4%, preferably 0.05–0.15% is used for grain refining. Above about 0.4% vanadium should not be used because of its adverse effect on impact strength. When grain coarsening, which may result during case hardening and heat treatment, adversely affects impact strength and fracture toughness, at least a minimum of a grain refiner is included such as at least about 0.03% V or 0.01% Cb. It is contemplated that about 0.03%–0.4% vanadium or the preferred amount of 0.05–0.15% may be used with either the broad or preferred ranges of the remaining elements of this composition.

It has been found that when the foregoing combination of the elements carbon, manganese, silicon, chromium, nickel and copper with optional vanadium are balanced, as was just described, with a critical amount of molybdenum, then the unique combination of case-hardened and heat-treated properties of high core impact strength and fracture toughness with a high temper resistance and hot hardness of this alloy is attained. In this composition, molybdenum contributes to deep hardenability and promotes temper resistance together with a unique degree of hardness retention. For these effects, a minimum of 2.5% molybdenum is required. Temper resistance and hot hardness are enhanced as the molybdenum content is increased to about 4%, but because increasing molybdenum tends to lower impact strength, with 4.0% molybdenum present no more than about 0.11% carbon or better yet no more than about 0.10% carbon should be used if a core impact strength of at least about 60 ft-lb is to be obtained. Preferably 3.0–3.5% molybdenum is used and for a best combination of temper resistance and case hot hardness with core impact strength and fracture toughness, less than 0.12% carbon should be present. Molybdenum in the amounts of 2.5%–3.5% and 3%–4% are also contemplated. Thus, the larger amounts of carbon and the larger amounts of molybdenum contemplated herein should not be used together because each lowers the core impact strength. When adjusting these elements, it should be helpful to note that an increase of about 0.01% of the carbon content when carbon is present in an amount of 0.10% or more has a much greater effect in reducing impact strength than an increase of about 0.25% molybdenum when molybdenum is present in an amount of 3.0% or more.

This alloy is readily prepared by means of conventional, well-known techniques, but, for best results, consumable electrode remelting carried out under reduced pressure is preferred. Normalizing is not an essential practice, but may be used when desired to optimize properties. When normalizing, the temperatures used should be above the hardening temperature for the specific analysis and will vary with the molybdenum content from about 1650°–1800° F. (about 900°–980° C.) and is followed by cooling in air. Annealing may be carried out below or above the critical temperature ($A_{c1}$) and from about 1200°–1500° F. (about 650°–815° C.) followed by cooling slowly in the furnace. Parts are stress relieved as required to eliminate minor machining or other surface stresses at about 1100° F. (593° C.) for one hour followed by cooling in air. Higher temperatures up to an annealing temperature may be used as required. For case hardening, the alloy is preferably carburized long enough to secure the desired case depth and hardness. Parts can be hardened by cooling in the furnace from the carburizing temperature to the hardening temperature and then quenching but for best properties, particularly toughness, the parts should be cooled to room temperature from the case-hardening temperature and then hardened by heating above the $A_{c3}$ temperature which increases with increasing molybdenum content. Also, hardening temperatures no less than about 1675° F. (about 912° C.) are preferred to provide highest core hardness.

For maximum hardness and impact strength, tempering should be carried out at the lowest temperature consistent with the hightest temperature to which parts may be expected to be exposed in use. In the case of gears which may be exposed to service temperatures as high as 400° F. (204° C.), tempering at 500° F. (260° C.) for two successive periods of two hours is preferred.

EXAMPLE 1

As an example of the present invention, a 300 lb (136 kg) vacuum induction heat was prepared as a 5 inch (12.7 cm) round electrode which was then vacuum arc remelted to form a 7¾ inch (19.7 cm) round ingot having the following composition as the average of two analyses, one from the top and the other from the bottom of the ingot:

TABLE II

| | w/o |
|---|---|
| C | 0.100 |
| Mn | 0.27 |
| Si | 1.07 |
| Cr | 1.04 |
| Ni | 2.02 |
| Cu | 2.09 |
| Mo | 3.25 |
| V | 0.11 |

with the balance iron except for incidental impurities which included 0.005% phosphorus and 0.003% sulfur. The ingot was forged from a furnace temperature of 2050° F. (1121° C.) to a four inch (10.16 cm) round cornered square billet, portions of which were forged to 1⅛ in (2.86 cm) square and 1¼ in×2 in (3.18 cm×5.08 cm) rectangular bars for further testing. The bars were annealed by heating at 1330° F. (721° C.) for 4 hours, cooled 30° F. (16.67° C.)/hr to 1256° F. (680° C.) and held for 4 hrs, then cooled 30° F./hr to 1100° F. (593° C.) followed by cooling in air to room temperature. As thus prepared and annealed, the hardness was Rc 23.

Case hardening when carried out was by carburizing, heating at 1700° F. (927° C.) for 7 hours in an endothermic atmosphere at a +7° F./+8° F. (−13.89° C./−13.33° C.) dew point. When the core properties alone were desired to be tested, a nitrogen ($N_2$) cover gas was substituted for the carburizing gas (hereinafter pseudocarburizing).

Charpy V-notch (CVN) impact specimens were pseudocarburized, austenitized for 25 minutes at 50° F. intervals between 1650° F. and 1850° F. (899° C. and 1010° C.), oil quenched or air cooled, then refrigerated at −100° F. (−73.33° C.) for ½ hour, tempered at 500° F. (260° C.) for two successive two-hour periods. Impact strengths (foot-pounds and Joules) and hardnesses are listed in Table III.

TABLE III

| Austenitizing Temp. °F. (°C.) | Oil Quenched CVN Impact ft-lb (J) | Oil Quenched Hardness Rc | Air Cooled CVN Impact ft-lb (J) | Air Cooled Hardness Rc |
|---|---|---|---|---|
| 1650 (899) | 106 (143.7) | 34.0 | 91 (123.4) | 34.5 |
| | 97 (131.5) | | 91 (123.4) | |
| | 93 (126.1) | | 84 (113.9) | |
| 1700 (927) | 96 (130.2) | 37.5 | 73 (99.0) | 36.5 |
| | 98 (132.9) | | 75 (101.7) | |
| | 84 (113.9) | | 67 (90.8) | |
| 1750 (954) | 54 (73.2) | 36.5 | 40 (54.2) | 36.0 |
| | 54 (73.2) | | 52 (70.5) | |
| | 64 (86.8) | | 44 (59.7) | |
| 1800 (982) | 71 (96.3) | 38.5 | 56 (75.9) | 38.0 |
| | 67 (90.8) | | 44 (59.7) | |
| | 62 (84.1) | | 51 (69.2) | |
| 1850 (1010) | 68 (92.2) | 39.0 | 54 (73.2) | 39.0 |
| | | | 61 (82.7) | |
| | | | 65 (88.1) | |

From Table III, it is apparent that for best core impact strength, the austenitizing temperature should be below 1750° F. (954° C.), and oil quenching consistently gives better results than cooling in air. The highest average impact strength was 98.7 ft-lb (133.8 J) obtained with an austenitizing temperature of 1650° F. (899° C.) followed by quenching in oil.

To compare the effects of different tempering temperatures on the core, pseudocarburized specimens are used, and, for their effect on the case-hardened material, carburized specimens were used. The oil-quenched and refrigerated hardness (from austenitizing at a temperature of 1675° F. (913° C.) for 25 minutes) are indicated in Table IV for the tempering temperatures and treatments indicated. Before tempering, that is in the as-quenched+refrigerated condition, the core hardness was Rc 34.0 and the case hardness was Rc 66.5. That case hardness and the hardnesses indicated in Table IV were measured on the Rockwell A scale and converted to the corresponding Rc value.

TABLE IV

| Temp. °F. | Temp. (°C.) | Core Tempered 1 hr | Core Tempered 2 + 2 hr | Case Tempered 1 hr | Case Tempered 2 + 2 hr |
|---|---|---|---|---|---|
| 300 | (149) | 35.0 | 34.5 | 63.0 | 62.5 |
| 350 | (177) | 35.0 | 35.0 | 62.0 | 62.0 |
| 400 | (204) | 34.5 | 35.0 | 61.5 | 62.0 |
| 450 | (232) | 35.0 | 35.0 | 61.5 | 61.5 |
| 500 | (260) | 35.0 | | 61.0 | |
| 550 | (288) | 35.0 | | 61.0 | |
| 600 | (315) | 35.0 | | 61.0 | |
| 700 | (371) | 35.5 | | 58.5 | |
| 800 | (427) | 38.0 | | 56.5 | |
| 900 | (482) | 41.0 | | 56.0 | |
| 1000 | (538) | 38.5 | | 55.0 | |
| 1100 | (593) | 35.5 | | 52.0 | |
| 1200 | (650) | 26.0 | | 45.5 | |

Charpy V-notch and room temperature tensile specimens were prepared, pseudocarburized, hardened by heating at 1675° F. (913° C.) for 25 minutes, oil quenched, then refrigerated at −100° F. (−73° C.) for one-half hour and tempered at 400° F. (204° C.) for two successive periods of two hours. Fracture toughness specimens were prepared in the same way, except that heating at 1675° F. was for 30 minutes. At −65° F. (−54° C.), three CVN impact tests gave 41 ft-lb, 39 ft-lb and 41 ft-lb (55.6 J, 52.9 J, 55.6 J), while at room temperature, three CVN impact specimens gave 95 ft-lb, 91 ft-lb and 87 ft-lb (128.8 J, 123.4 J, 117.9 J), and at 212° F. ( 100° C.), three CVN impact specimens gave 103 ft-lb, 120 ft-lb and 112 ft-lb (139.6 J, 162.7 J, 151.8 J). Fracture toughness results of three tests were each greater than 90 ksi $\sqrt{in}$ (98.9 $MN/m^2\sqrt{m}$). Room temperature tensile tests, as an average of three tests each, were carried out giving a 0.2% yield strength of 141 ksi (972.75 $MN/m^2$), an ultimate tensile strength of 170 ksi (1172 $MN/m^2$) with an average elongation of 16.4% and an average reduction in area of 66.5%.

Core and case hot hardness specimens were prepared and treated as was just described in connection with the Charpy V-notch and room temperature tensile specimens except that the case test specimens were carburized by heating at 1700° F. (927° C.) for seven hours in a +7° F. (3.89° C.) dewpoint endothermic atmosphere. The resulting hardnesses, measured at the temperature indicated, are shown in Table V, the case hardnesses are the average of two tests converted from the Ra scale.

TABLE V

| Test Temp. °F. | (°C.) | Core Hardness Rc | Case Hardness Rc |
|---|---|---|---|
| Room | | 35.0 | 62.0 |
| 200 | (93) | 35.5 | 60.0 |
| 300 | (149) | 34.5 | 59.5 |
| 400 | (204) | 34.0 | 58.0 |
| 500 | (260) | 35.0 | 56.5 |
| 600 | (315) | 35.5 | 54.5 |
| 700 | (371) | 35.0 | 49.5 |
| 800 | (427) | 35.0 | 47.0 |
| 900 | (482) | 34.5 | 43.0 |
| 1000 | (538) | 28.0 | 39.0 |

The data in Table V demonstrates that the core hardness of this composition remains essentially constant until a temperature of about 900° F. (482° C.) is exceeded. The case hardness declines with increasing temperature, but at temperatures as high as 600° F. (315° C.), the composition still retains a high degree of hot hardness.

The alloy of the present invention provides a unique combination of properties so that when case hardened an outstanding combination is attained of core impact strength and fracture toughness combined with a high degree of temper resistance and case hot hardness when used at temperatures as high as 400° F. (204° C.). And when the composition contains the preferred minimum amounts of Si, Cr, Ni, Cu, and Mo, that is, about 0.06–0.16% C, 0.25–0.7% Mn, 0.75–1.5% Si, 0.75–1.5% Cr, 1.7–3% Ni, 1.5–4% Cu, 3–4% Mo, with the sum of the percent Ni plus one-half the percent copper equal to or less than 4%, and the balance iron with or without the addition of optional elements, a minimum room temperature case hardness of Rc 62 is attainable. Another analysis which has outstanding properties contains

| | w/o |
|---|---|
| C | 0.10 |
| Mn | 0.35 |
| Si | 1.0 |
| Cr | 1.0 |
| Ni | 2.0 |
| Cu | 2.0 |
| Mo | 3.25 |
| V | 0.10 |

with the balance iron plus incidental impurities with or without small amounts of Al, Cb, Ti, Zr and Ca.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A case-hardening alloy steel which when case hardened and heat treated has, at room temperature, a core which has a hardness of at least Rc 32, a Charpy V-notch impact strength of at least 60 ft-lb, a fracture toughness of at least 80 ksi $\sqrt{in}$ combined with a case which has at room temperature a hardness of at least Rc 60 and a hot hardness at 400° F. of at least Rc 56, said alloy steel consisting essentially in weight percent of

| | w/o |
|---|---|
| C | 0.06–0.16 |
| Mn | 0.2–0.7 |
| Si | 0.5–1.5 |
| Cr | 0.5–1.5 |
| Ni | 1.5–3 |
| Cu | 1–4 |
| Mo | 2.5–4 |
| V | Up to 0.4 |
| P | Up to 0.05 |
| S | Up to 0.05 |
| N | Up to 0.03 |
| Al | Up to 0.25 |
| Cb | Up to 0.25 |
| Ti | Up to 0.25 |
| Zr | Up to 0.25 |
| Ca | Up to 0.25 |

the sum of the percent nickel plus one-half the percent copper being equal to or less than 4%, and the balance consisting essentially of iron.

2. The alloy steel as set forth in claim 1 which contains at least 0.03% V and no more than 0.1% of each Al, Cb, Ti, Zr and Ca.

3. The alloy steel as set forth in claim 2 which contains about

| | |
|---|---|
| C | 0.07–0.13 |
| Mn | 0.25–0.5 |
| Si | 0.75–1.25 |
| Cr | 0.75–1.25 |
| Ni | 1.7–2.3 |
| Cu | 1.5–2.5 |
| Mo | 3–3.5 |
| V | 0.05–0.15 |

4. The alloy as set forth in claim 2, which contains no more than 0.13% carbon, no more than 0.5% manganese, no more than 1.25% silicon, no more than 1.25% chromium, no more than 2.3% nickel, no more than 2.5% copper, no more than 3.5% molybdenum, and no more than 0.15% vanadium.

5. The alloy steel as set forth in claim 4 which contains at least 3% molybdenum.

6. The alloy steel as set forth in claim 2 which contains

| | w/o |
|---|---|
| C | 0.1 |
| Mn | 0.35 |
| Si | 1 |
| Cr | 1 |
| Ni | 2 |
| Cu | 2 |
| Mo | 3.25 |
| V | 0.1 |

7. The alloy steel as set forth in claim 2 which is case hardenable and heat treatable to a room temperature hardness of Rc 62 and which contains at least about 0.75% Si, 0.75% Cr, 1.7% Ni, 1.5% Cu, and 3% Mo.

8. A wrought, case-hardened and heat-treated article formed from the alloy steel of claim 1.

9. A wrought, case-hardened and heat-treated article formed from the alloy steel of claim 2.

10. A wrought, case-hardened and heat-treated article formed from the alloy steel of claim 3.

11. A wrought, case-hardened and heat-treated article formed from the alloy steel of claim 4.

12. A wrought, case-hardened and heat-treated article formed from the alloy steel of claim 5.

13. A wrought, case-hardened and heat-treated article formed from the alloy steel of claim 6.

14. A wrought, case-hardened and heat-treated article formed from the alloy steel of claim 7.

* * * * *

UNITED STATES PATENT OFFICE

CERTIFICATE OF CORRECTION

PATENT NO. : 4,157,258

DATED : June 5, 1979

INVENTOR(S) : Thoni V. Philip & Robert W. Krieble

It is certified that error appears in the above-identified patent and that said Letters Patent are hereby corrected as shown below:

Col. 3, line 13 for "and" read -- the --

Col. 5, line 28 delete "and"

Col. 5, line 48, for "hightest" read -- highest --

Col. 6, line 61 for "are" read -- were --

Col. 7, line 47, for "(3.89°C)" read -- (-13.89°C) --

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*